United States Patent [19]

Sweeney et al.

[11] Patent Number: 4,460,379

[45] **Date of Patent: * Jul. 17, 1984**

[54] STABILIZED MIDDLE DISTILLATE FUEL COMPOSITION

[75] Inventors: William M. Sweeney, Wappingers Falls; Rodney L. Sung, Fishkill, both of N.Y.; Wheeler C. Crawford, Houston, Tex.

[73] Assignee: Texaco Inc., White Plains, N.Y.

[ * ] Notice: The portion of the term of this patent subsequent to Jul. 5, 2000 has been disclaimed.

[21] Appl. No.: 412,621

[22] Filed: Aug. 30, 1982

[51] Int. Cl.[3] ..... C10L 1/22

[52] U.S. Cl. ..... 44/56; 44/72; 252/392

[58] Field of Search ..... 44/56, 72; 252/392

[56] References Cited

U.S. PATENT DOCUMENTS

| | | | |
|---|---|---|---|
| 1,989,528 | 1/1935 | Rather et al. | 44/72 |
| 2,902,354 | 9/1959 | Giammaria | 44/72 |
| 2,974,023 | 3/1961 | Cyba et al. | 252/392 |
| 3,203,904 | 8/1965 | Brown | 252/392 |
| 3,637,358 | 1/1972 | Cyba | 44/72 |

*Primary Examiner*—Y. Harris-Smith

*Attorney, Agent, or Firm*—Robert A. Kulason; James J. O'Loughlin

[57] ABSTRACT

A fuel composition comprising a mixture of hydrocarbons boiling in the middle distillate boiling range and, an effective stabilizing amount of a hydrocarbyl polyoxypropylene di(polyoxyethylene)amine represented by the formula:

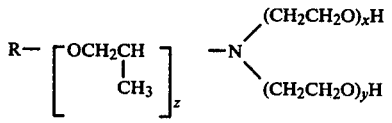

wherein R is a hydrocarbon radical having from 1 to 50 carbon atoms, x and y have values from 1 to 16, the sum of x plus y is from 2 to about 17, and z is from 1 to about 20.

8 Claims, No Drawings

STABILIZED MIDDLE DISTILLATE FUEL COMPOSITION

BACKGROUND OF THE INVENTION

1. Field of the Invention

Various types of petroleum-derived hydrocarbon oils undergo deterioration on storage or upon exposure to severe conditions such as exposure to air on standing at room temperature for extended lengths of time. Thus fuel oils, such as diesel fuel, jet fuel, burner oil, and furnace oils undergo deterioration as evidenced by such changes as the formation of sediment. This deterioration depends in part on the composition of the blending stock which make up the fuel. In general the more cracked stocks used in making up the fuel blend, the greater the instability of the fuel. Similarly, fuel derived from tar sands, shale oil, or by the H-Oil process generally have a higher naphthenic content and are less stable. Other factors contributing to instability would include the cleanliness of the fuel itself and the conditions of storage.

Sediment formation is undesirable for various reasons. The settling of the accumulated particles in tanks storing hydrocarbon oils requires periodic draining and cleaning of the storage tanks leading to temporary unavailability of storage capacity, substantial deversion of manpower, and waste disposal problems. Sediment formation in burner oil tends to plug strainers, burner tips, and injectors. In diesel fuel, such sediment tends to form sludge and varnish in the engine. If the oil is used as a heat exchange medium, as for example with jet fuel, the sediment tends to plug exchanger coils. It is apparent, therefore, that reduced sediment formation in hydrocarbon oils is very important.

One method of effecting sediment reduction would be to eliminate, to a substantial degree, those processes leading to particulate formation, such as oxidation. Another method would be to prevent agglomeration and/or settling of the formed particulate matter by effectively maintaining the fine particles in a well dispersed state, so that the difficulties associated with the sediment formation either do not occur or are of substantially lessened severity.

It is the primary object of this invention to improve the stability of middle distillate fuels against the formation and precipitation of sediment.

2. Description of the Prior Art

Copending application Ser. No. 338,196 filed Jan. 8, 1982, now U.S. Pat. No. 4,391,610, discloses a dialkoxylated alkyl polyoxyalkyl tertiary amine as a corrosion inhibitor for gasoline fuels.

SUMMARY OF THE INVENTION

A stabilized middle distillate fuel composition has been discovered comprising a mixture of hydrocarbons boiling in the middle distillate boiling range, (300° to 700° F.) and a minor stabilizing amount of a hydrocarbyl polyoxypropylene di(polyoxyethylene) amine having the following formula:

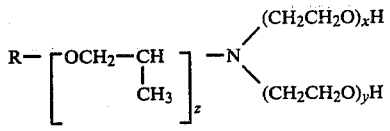

wherein R is an hydrocarbyl radical having from 1 to 50 carbon atoms, x and y have values from 1 to 16, the sum of x plus y is from 2 to about 17 and z is from 1 to about 20. Middle distillate fuel compositions containing substantial amounts of cracked hydrocarbon stocks or hydrocarbons derived from non-mineral oil sources are also improved by the prescribed stabilizers.

DETAILED DESCRIPTION OF THE INVENTION

This invention is particularly concerned with middle distillate fuels comprising hydrocarbons boiling in the range from about 300° F. to about 700° F., and containing a minor stabilizing amount of an additive having the following formula:

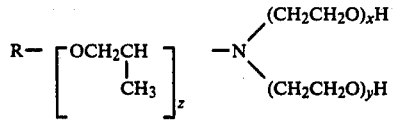

wherein R is a hydrocarbyl radical having 1 to 50 carbon atoms and x and y have values from 1 to 16, the sum of x and y is from about 2 to about 17 and z is from 1 to about 20. Preferably R has from about 5 to 25 carbon atoms and most preferably 10 to 12 carbon atoms. The sum of x and y is preferably from about 2 to about 10 and most preferably from about 2 to about 6. Preferably z is 1 to 2 and most preferably z is 2.

The hydrocarbon fuels with which this invention is primarily concerned are petroleum distillates or any mixture of these that can be employed in various burner systems, as fuels for diesel engines, as aviation turbine fuels, and as domestic or industrial heating oils. These fuels may be generally characterized as those that consist of a major proportion of hydrocarbons boiling in the range of from about 300° F. to about 750° F., and particularly those boiling between 400° F. and 650° F. It is a common practice to incorporate cracked hydrocarbon stocks in such fuels, and this practice aggravates the tendency of the fuels to form sediment on storage. It has been found that if 10 percent or more of a fuel composition comprises cracked stocks, the formation of sludge or sediment during storage may markedly increase, leading to the plugging or fouling of oil lines, filters and burner nozzles.

It is also possible to incorporate hydrocarbon stocks from non-mineral oil sources, such as tar sands and shale oil, or hydrocarbon stocks obtained by the H-Oil process into the fuels of this invention. This practice, probably because of the naphthenic content of such non-mineral oil fuel extenders, aggravates sediment formation in these fuels.

The amount of non-mineral oil middle distillate fuel which may be employed to extend the conventional mineral oil fuel composition of this invention will range from about 1 to 30 weight percent of the fuel composition. The preferred amount of non-mineral oil extender based on the total weight of the extended middle distillate fuel composition ranges from about 5 to 15 weight percent with the most preferred amounts ranging from about 5 to 10 weight percent.

Typical fuels for use in accordance with the present invention are those meeting the requirements for Diesel 1 and Diesel 2 fuel oils as set forth in ASTM Specification D-396-48T, diesel fuels falling within D-1, D-2 and D-4 grades of ASTM Specification D0975-51T and aviation fuels for gas turbines as covered by U.S. military Specification MIL-F-5624C.

The middle distillate fuels, improved by this discovery are derived from straight run middle distillate fuels, thermal and catalytically cracked hydrocarbon fuels and mixtures of cracked fuels and straight run middle distillate fuels distilling within the range 100° to about 750° F. Both the cracked fuels as well as the blends of cracked and straight run fuels may be acid or caustic treated to improve their stability. Middle distillate fuels which have a marked tendency toward sludging and deposit formation are primarily cracked fuels or blends which are composed mainly of cracked fuels. The so-called light and intermediate cycle gas oil fractions from thermal cracking and catalytic cracking, and which are economically used in furnace oil blends and "economy" diesel fuels, are particularly prone to form deposits.

Particularly improved middle distillate fuel compositions are those containing substantial amounts of hydrocarbon stock within the prescribed boiling range but derived from non-mineral oil sources. Non-mineral oil stocks derived from shale oil, tar sands or synthetically produced tend to impair the storage stability of middle distillate fuels into which they are blended with the result that such blended fuel composition have a need for an effective stabilizer.

The hydrocarbyl polyoxypropylene di(polyoxyethylene) amine component of the inventive fuel is prepared by reacting an appropriate hydrocarbyl polyoxypropylene amine with ethylene oxide. In general, 1 mole of the hydrocarbyl polyoxypropylene amine is reacted with 2 moles of ethylene oxide by conventional alkoxylation procedures.

Preparation of the sediment inhibiting additives of the instant invention having higher ethoxylation numbers requires further reacting this hydrocarbyl polyoxypropylene diethanol amine with additional moles of ethylene oxide. The number of additional moles of ethylene oxide required will be equal to $[(x+y)-2]$ in order to obtain hydrocarbyl polyoxypropylene di(poly$(x+y-2)$ oxyethylene amines.

In accordance with the present invention the sediment forming tendencies of middle distillate hydrocarbon fuels, and particularly heating oils, can be markedly reduced by incorporating effective amounts, ordinarily minor proportions of the order of about 0.0001 to 0.05 percent by weight of hydrocarbyl polyoxypropylene di(polyoxyethylene) amines into the fuel composition. Preferably the sediment inhibiting amine comprises from about 0.005 to 0.01 weight percent of the middle distillate fuels of the invention and most preferably about 0.0095 weight percent.

Specific examples of the stabilizers of this invention are illustrated below:

EXAMPLE I 285 grams (1 mole) of a mixture of n decyl and dodecyl di oxypropylene amine (Jeffamine$^{(R)}$ M-300) having the following formula:

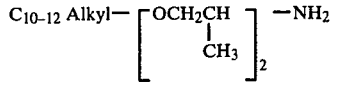

were reacted with 88 grams (2 moles) of ethylene oxide at conventional alkoxylation reaction conditions. Analysis of the resulting product shows that it contains 2.7 meq/gram total amines and has a structure corresponding to the following formula:

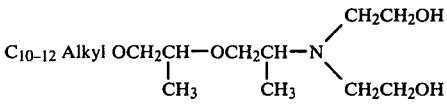

In similar fashion, products containing 5, 10, 15 and 20 moles of ethylene oxide per mole of amine were prepared. These are Examples 2, 3, 4 and 5 respectively.

EXAMPLE 2

Analysis of the Example 2 product indicates that it contains approximately 2 meq/g total amines and has a structure corresponding to the following formula:

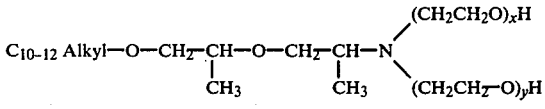

where in the sum of $x+y$ is 5.

EXAMPLE 3

Analysis of the Example 3 product indicates that it contained approximately 1.35 meg/gram total amines and had a structure corresponding to the following formula:

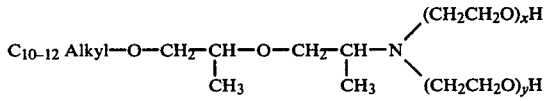

in which the sum of x plus y is 10.

EXAMPLE 4

Analysis of the Example 4 product indicates that it contained approximately 1.0 meq/gram total amines and had a structure corresponding to the formula:

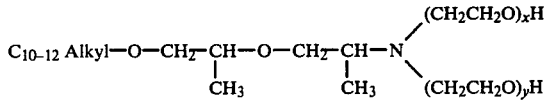

in which the sum of x plus y is 15.

EXAMPLE 5

Analysis of the Example 5 product indicated that it contained approximately 0.75 meq/grams total amines and had a structure corresponding to the following formula:

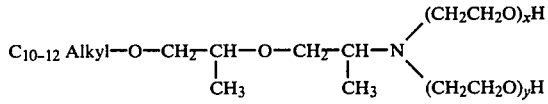

in which the sum of x plus y is 20.

Each of the amines of Examples 1 through 5 was tested for stability in the Potential Deposit Test. The Potential Deposit Test procedure requires filtering of 100 ml of the test fuel into a test tube through a 15 centimeter Number 1 Whatman filter paper. An air delivery tube was inserted in the test tube through a cork that has been slotted on the sides to allow the air to escape. The delivery tube was adjusted so that its tip which has been cut at a 45 degree angle, just touches the bottom of the test tube. The test tube was placed in an oil bath of 270±1° F. and preheated. The delivery tube was connected to a flow meter and air was bubbled through the fuel for 2 hours at a rate of 3 liters per hour. To remove acidic materials from the air, the air was first bubbled through 20% caustic solution, and then bubbled through distilled water prior to passing it through the test fuel. The test tube was removed from the oil bath, the oil was wiped from the outside of the tube and the tube was placed in a constant temperature bath maintained at 77±0.5° F. The test fuel sample was then filtered using suction at pressure of 75 to 85 mm Hg below atmospheric pressure through a 4.25 cm. No. 1 Whatman filter paper clamped between two halves of Millipore filter holder. The fuel oil from the funnel and filter paper was washed with three, 5 ml portions of n-heptane. The filter paper disk was removed and compared visually with those on the Potential Deposit Code.

The Base Fuel employed in the Potential Deposit Test was a mineral oil processed by conventional refining methods and having the following characteristics:

| | |
|---|---|
| Gravity, API | 35.2 |
| Kinetic Viscosity, 100° F., cs | 2.86 |
| Flash Point, °F. | 162 |
| Pour Point, °F. | +5 |
| Cloud Point, °F. | +4 |
| ASTM distillation: | |
| Initial boiling point | 400° F. |
| 10% distilled at | 426° F. |
| 30% distilled at | 479° F. |
| 50% distilled at | 517° F. |
| 70% distilled at | 554° F. |
| 90% distilled at | 597° F. |
| 95% distilled at | 615° F. |
| Final Boiling Point | 628° F. |

The results of the Potential Deposit Test are shown below in Table I.

TABLE I

| | | The Potential Deposit Test | |
|---|---|---|---|
| Run | Fuel | Additive @ Concentration, wt. % | Test Rating(1) |
| 1 | Base Fuel | No additive | 4+ |
| 2 | Base Fuel | Example 1, 0.0095 wt % (25PTB) | 1 |
| 3 | Base Fuel | Example 2, 0.0095 wt % (25PTB) | 1 |
| 4 | Base Fuel and 1 wt % Ethanol(2) | No additive | 4+ |
| 5 | Base Fuel and 1 wt % Ethanol | Example 3, 0.0095 wt % (25PTB) | 2 |
| 6 | Base Fuel and | Example 4, | 2 |

TABLE I-continued

| | | The Potential Deposit Test | |
|---|---|---|---|
| Run | Fuel | Additive @ Concentration, wt. % | Test Rating(1) |
| | 1 wt % Ethanol | 0.0095 wt % (25PTB) | |
| 7 | Base Fuel and 1 wt % Ethanol | Example 5, 0.0095 wt % (25PTB) | 3(3) |

(1)0 good +4 bad
(2)1% Ethanol was employed to dissolve the amine additive in the base fuel
(3)unaaceptable value for commercial purposes.

As shown by the data in Table I each of the mixture of decyl and dodecyl dioxypropylene di(polyoxyethylene) amines Examples 1 through 4 were very effective in stabilizing the fuel against sediment formation. Example 5, although it improved fuel stability, was not effective enough in stabilizing the fuel composition against sediment formation to be commercially useful.

It is understood that this invention is not to be limited to the specific examples herein presented. Scope of the invention is to be determined by the appended claims, and all modifications within that scope are contemplated in the practice of this invention.

We claim:

1. A middle distillate fuel composition comprising a mixture of hydrocarbons boiling in the range from about 400° F. to about 650° F. and an effective sediment inhibiting amount of a hydrocarbyl polyoxypropylene di(polyoxyethylene) amine having the following formula:

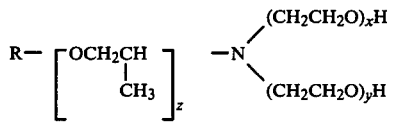

wherein R is a hydrocarbyl radical having 1 to 50 carbon atoms and x and y have values from 1 to 16 and the sum of x plus y is from 2 to about 17, and z is from 1 to about 20.

2. A claim according to claim 1 wherein R is an alkyl group having from about 5 to 50 carbon atoms, the sum of x plus y is 10 and z is 2.

3. A claim according to claim 1 wherein R is an alkyl group having from about 5 to 25 carbon atoms, the sum of x plus y is 15 and z is 2.

4. A claim according to claim 1 wherein R is an alkyl group having from about 10 to 12 carbon atoms, the sum of x plus y is 2 and z is 2.

5. A claim according to claim 4 but wherein the sum of x plus y is 5 and z is 2.

6. A fuel composition according to claim 1 containing from about 0.0001 to 0.05 weight percent of said sediment inhibiting amine.

7. A fuel composition according to claim 1 wherein the sediment inhibiting amine is present in from about 0.005 to 0.01 weight percent.

8. A fuel composition according to claim 1 wherein the sediment inhibiting amine is present in about 0.0095 weight percent.

* * * * *